US009456269B2

(12) United States Patent
Perkmann et al.

(10) Patent No.: US 9,456,269 B2
(45) Date of Patent: Sep. 27, 2016

(54) PLUG EARPHONE OR A CONCHA EARPHONE

(71) Applicant: AKG Acoustics GmbH, Vienna (AT)

(72) Inventors: Michael Perkmann, Vienna (AT); Hannes Lehdorfer, Vienna (AT); Alex Dobrocsi, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 14/289,460

(22) Filed: May 28, 2014

(65) Prior Publication Data

US 2014/0355810 A1 Dec. 4, 2014

(30) Foreign Application Priority Data

May 28, 2013 (EP) ..... 13169485

(51) Int. Cl.
*H04R 25/00* (2006.01)
*H04R 1/10* (2006.01)
*H04R 1/28* (2006.01)

(52) U.S. Cl.
CPC ..... *H04R 1/1091* (2013.01); *H04R 1/1016* (2013.01); *H04R 1/2803* (2013.01)

(58) Field of Classification Search
CPC ..... H04R 1/1016
USPC ..... 381/71.6, 308, 310, 380, 381, 382
See application file for complete search history.

(56) References Cited

U.S. PATENT DOCUMENTS 8,098,854 B2 * 1/2012 van Halteren et al. ..... 381/182
2008/0298623 A1 * 12/2008 Klein ..... H04R 1/2857 381/380
2011/0051980 A1 3/2011 Kuhr
2012/0201406 A1 * 8/2012 Yamaguchi ..... 381/309

FOREIGN PATENT DOCUMENTS

GB 2492959 A * 1/2013 ..... H04R 1/1083
GB 2492959 A1 1/2013

OTHER PUBLICATIONS

European Search Report for corresponding Application No. 14169234.3, mailed Sep. 26, 2014, 8 pages.

* cited by examiner

*Primary Examiner* — Jesse Elbin
*Assistant Examiner* — Julie X Dang
(74) *Attorney, Agent, or Firm* — Brooks Kushman P.C.

(57) ABSTRACT

The invention relates to a plug earphone with a front portion and a rear portion, wherein a flexible plug can be placed on the front portion which includes an outer portion and an inner portion. An electroacoustic transducer is arranged in the rear portion, wherein the front portion is positioned on the electroacoustic transducer and on an opening of the rear portion produced in this area. To achieve a reliable acoustic friction piece which is easy to manufacture, the front portion, and optionally an inner portion and an outer portion, together with a front wall of the rear portion, forms at least one radial channel leading from the interior of the front portion to the outside, and an acoustic friction piece is optionally arranged in the radial channel.

20 Claims, 2 Drawing Sheets

PLUG EARPHONE OR A CONCHA EARPHONE

CROSS-REFERENCE TO RELATED APPLICATIONS

This application claims priority to EP Application No. 13 169 485.3, filed May 28, 2013, the disclosure of which is incorporated in its entirety by reference herein.

TECHNICAL FIELD

The invention relates to a plug earphone or a concha earphone with an acoustic friction piece. Plug earphones are, contrary to concha earphones, not acoustically tight in respect to the ear channel, but otherwise they are very similar to them.

BACKGROUND

U.S. Publication No. 2012/0201406 ("the '406 Publication") discloses a plug earphone with a special aim. There are two sound channels provided for a single transducer in order to come to a more natural hearing event. In practice, this leads to an acoustic friction which is divided into three special channels such as one connecting the front most part of the plug with the environment, another connecting the front space of the transducer with the environment and a third one connecting the rear volume of the transducer with the environment. Each of the channels is provided with special attenuation material in order to find the right balance for the whole earphone. This leads to a so-called first sound channel within the plug of the earphone and a so called second sound channel between the front space and the rear space of the transducer.

SUMMARY

FIG. 1 clearly illustrates aspects disclosed herein, if one contemplates that, the whole earphone in reality is very small, one recognizes that, all the various pieces of attenuation material (i.e., seven pieces), some of them having a size of a flyspeck. The manner in which to mount and fix various pieces of attenuation material is not clear.

One of the problems that should be mentioned as an example in connection with the '406 Publication (see FIG. 1 of the '406 Publication): the attenuation material 140*a* in the second sound channel 140: the attenuation material 140*a* is positioned between three parts: (i) the back housing 110B, (ii) the transducer 101 and (iii) the front housing 110F. The contact surface of the attenuation material with none of the three parts being arranged to be placed around the whole membrane-like material 140*a*. This condition renders the application of glue to require a high-tech form of application. The same is true for the attenuation material 150*a*″ in the opening 150", the latter having about 0.5 to 1.0 mm diameter and about the same length. Since it is impossible to apply the glue, which is necessary to fix the material on its very place and uniformly to each earpiece, this condition brings prominent acoustic differences within a series of earphones.

As disclosed herein, concha earphones denote headphones wherein the earplugs used have a special shape that is adapted to the shape of the user's auditory canal. Here, a front portion that is shaped appropriately and inserted in the auditory canal is mounted on a rear portion forming the housing proper, which remains outside the auditory canal; and which contains the electromagnetic transducer. As in all headphones and especially in those with earplugs, it is necessary in order to achieve satisfactory hearing events, to ensure an acoustic calibration, wherein, in the prior art, three mutually complementary possibilities that are interchangeable only to a very limited extent are available, which in the case of headphones with plugs can, in part, be used in practice, but, in part, they are known only theoretically.

The first calibration possibility is isobaric pressure compensation, which can be provided either as small a bore as possible in the front portion maximum diameter 3 mm or as a larger bore which is clogged appropriately with a relatively dense friction material piece.

The second calibration possibility is carried out by ventilation of the transducer, wherein, again, either merely a small bore is provided in the housing behind the plane of the transducer, or, in analogy to the isobaric pressure compensation, a larger bore is produced, naturally, also behind the transducer plane, which is, again, clogged with fitting friction material.

Finally, as the third calibration possibility, the acoustic short circuit has to be mentioned, which, however, in the case of concha earphones and other plug earphones, is only known in theory owing to the practical infeasibility and which can be used in practice only with other headphones, that is, those with ear cups.

As is apparent from the above explanations, even the two tuning methods that have been mastered to date have not actually been solved satisfactorily because, on the one hand, if extremely small bores are used, clogging or displacement always has to be expected; and, on the other hand, if openings are used that are clogged with an acoustic friction material piece and are appropriately secured (glued) in the openings, the labor expense is high and great care is also required, in order to always achieve results that are as consistent as possible.

Thus, there is a need for an acoustic friction piece for concha earphones which does not have the mentioned problems and which is capable of providing the appropriate tuning methods for such earphones in a cost effective and simple manner.

These aims are achieved according to the features indicated in a claim as set forth herein, by the fact that, between the front portion, also called the tube, and the rear portion of the housing, a radially extending acoustic channel is provided, which leads from the interior of the front portion to the periphery of the rear portion, where it opens to the outside. It is preferable that, in the area of the rear portion, the canal comprises a connection to an axially extending channel, which opens in an area of the rear portion located behind (viewed from the front portion) the transducer plane or the transducer.

In this manner, one achieves isobaric pressure compensation between the interior of the tube and the environment along the radially extending channel and ventilation of the transducer by the connection from the area behind the transducer plane to the opening of the radial channel which leads to the outside. Further, an acoustic short circuit is also achieved by the connection between the interior of the tube and the area behind the transducer.

BRIEF DESCRIPTION OF THE DRAWINGS

The invention is explained in greater detail below in reference to the drawing. The drawing shows.

DETAILED DESCRIPTION

Figure 1:
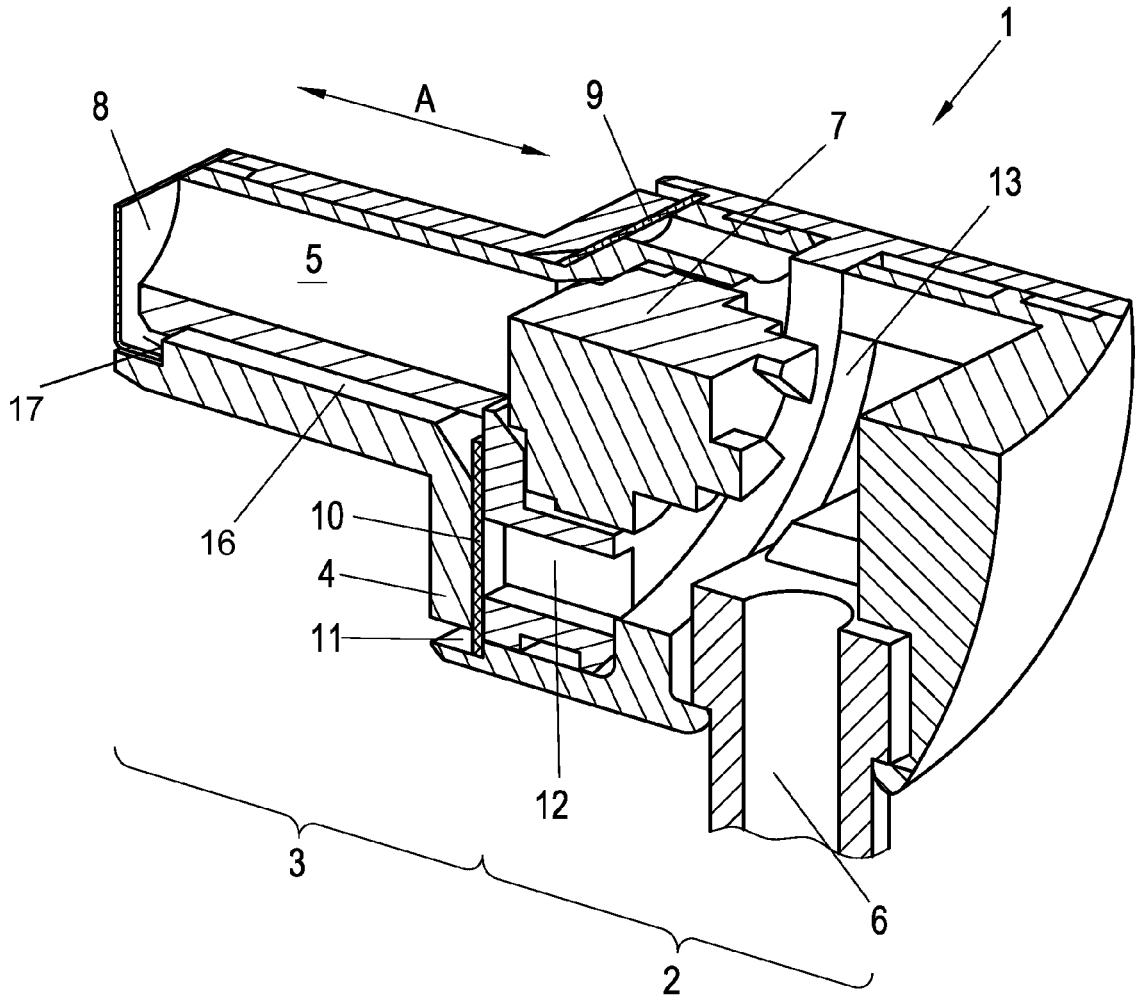
FIG. 1, purely diagrammatically, is a basic representation in a perspective view of a corresponding transducer in cross section.

FIG. 1 shows a concha earphone according to the invention without the flexible plug, the earphone is sectioned along two planes which together enclose 90° and which pass through a plug axis 15 (FIG. 2), so that a residual view of approximately one fourth of the earphone is represented. Here, it becomes clear that the earphone 1 includes substantially of a rear portion 2 and of a front portion (or tube) 3. In the rear portion 2, a supply line 6 opens; the rear portion 2 also comprises at least one electroacoustic transducer 7. The tube or front portion 3, in the represented embodiment, has a split design and the tube 3 includes an outer portion 4 and an inner portion 5. The inner portion 5 is substantially in the shape of a hollow cylinder and the inner portion 5 sits on the transducer 7, or on an opening of the housing of the rear portion 2 before the transducer 7, in order to lead the sound waves generated there in the axial direction A to a cover 8 at the end of the tube or front portion 3.

According to the invention, the inner portion 5 of the tube or front portion 3, in the area in which the tube 3 impinges on the rear portion 2, or on the transducer 7, comprises, in a first, not shown, embodiment, at least one, preferably several, perforations that extend radially, so that the interior of the inner portion 5 comprises at least a continuous connection to the outer portion 4. IN accordance to the disclosure herein, a continuing, substantially radially extending channel 9, is now formed at least in the area of at least one of these radial openings (or of the one radial opening), with at least one opening 11 leading outward to the outside environment. In the channel 9, it is preferable to provide an acoustic friction piece 10.

Figure 2:
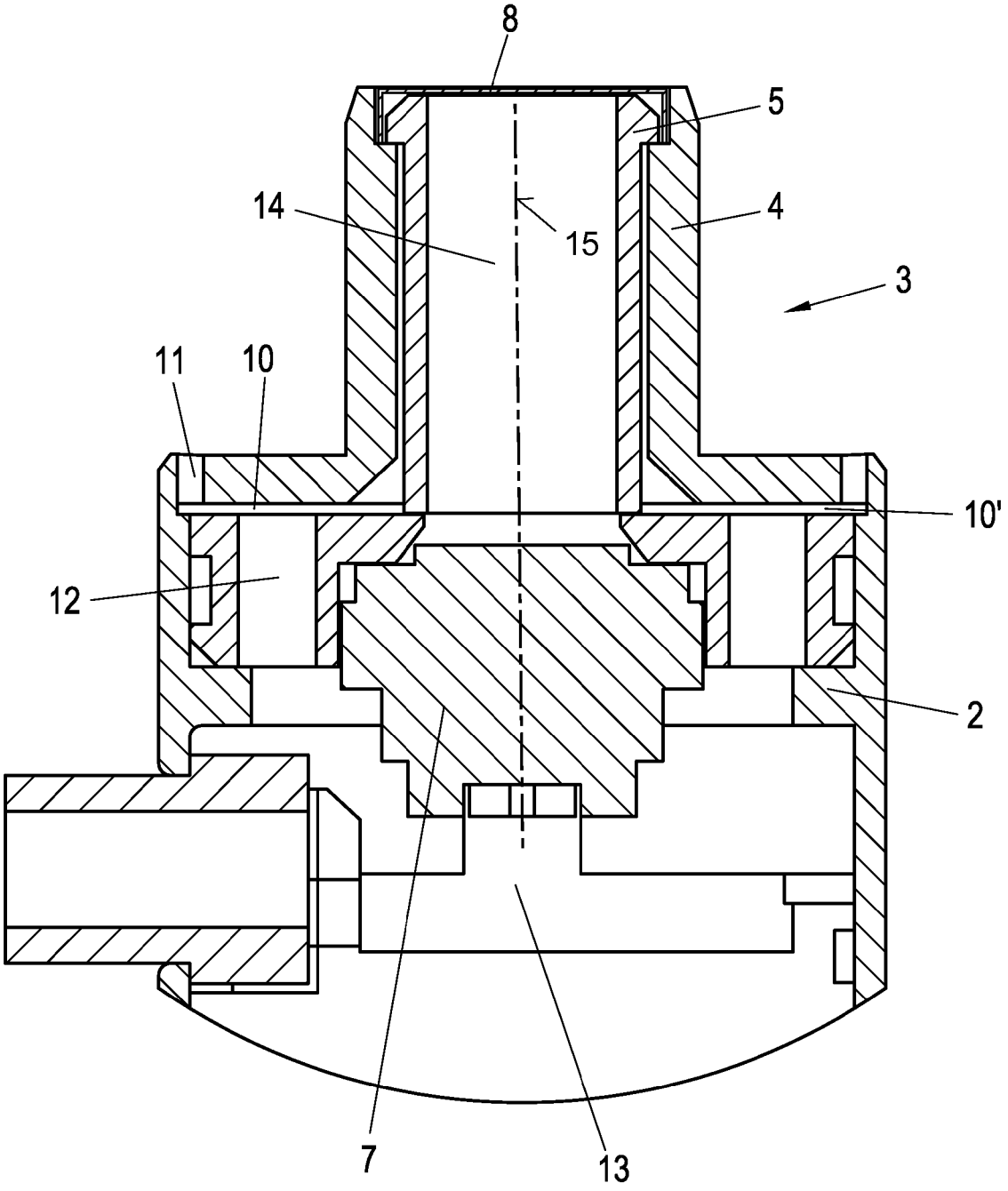
FIG. 2 is a similar representation with another section in a top view.

In FIGS. 1 and 2, two such openings 11 are visible, but it is clear that, there exists a large number of possibilities to diversify this. One may change the number and/or the size of the opening(s) depending on the technical outlay and implementation of the earphone.

It has to be stated that, in the depicted second embodiment, the outer portion 4 of the front portion has a slit extending from the acoustic friction piece 10 (or, if not present, the space where it would be) to the cover 8 on the foremost front of the front portion. This is given by not hatching the pertinent surface in FIG. 16. Parallel to this surface and in near vicinity extends a counter surface which is broken away in FIG. 1. The surface 16 and therefore the outer portion 4 in this area end or terminate at 17 in a distance of the cover 8. This provides for a sound channel around the front portion 3 (or tube) if, for any reason, the inner front of the front portion 3 rests along a closed line on the transducer or on an opening of the housing of the rear portion 2 before the transducer 7 without any of the perforations mentioned above.

In the represented embodiment example, the radial channel 9 is formed by a gap between the front area of the rear portion 2 and the rear area of the tube or front portion 3, more precisely the outer portion 4 of the tube or the front portion 3. Here, this hollow space is filled with an acoustic friction piece 10. Naturally, it is also possible to use, instead of a homogeneous, plate-shaped acoustic friction piece 10, different parts with another acoustic property; however, this will be reasonable only in the rarest of application cases.

The construction of a concha earphone or plug earphone according to the invention that has been described so far allows an isobaric pressure compensation, wherein the connection that is made available does not have the disadvantages mentioned at the beginning of the description in relation to the '406 publication. However, in addition, these measures according to the invention also make it possible to implement the two other tuning possibilities in embodiments in the simplest manner, as can be seen particularly in FIG. 2:

FIG. 2 shows a schematic section through the concha earphone of FIG. 1, also including the two other sound channels in the drawing:

On the one hand, the outer opening 11 is provided by a recess 12, which extends at least approximately parallel to the axis A in the area of the rear portion 2, and which opens, on the one hand, into the cavity 10, and, on the other hand, into a hollow or open rear area 13 which is located behind the transducer 7. With this connection, the ventilation of the transducer, and, as will be explained below, also the acoustic short circuit is produced, both also without entailing the disadvantages mentioned above in regard to the '406 publication.

Since the recess 12 impinges on the hollow space 10, the hollow rear area 13 of the rear portion 2 is also in acoustic connection with the interior 14 of the tube or front portion 3, and, thus, it represents the acoustic short circuit, which, to date, could not be produced at all in concha earphones.

The drawings directly show the possibilities made available by the invention to the person skilled in the art in the field of concha earphones, or also plug earphones. In the depicted embodiment example, the radial channel, here the hollow space 9, is filled practically completely by the acoustic friction piece 10. The term "radial" friction piece must nevertheless be kept, since the only function of this disk-shaped friction piece is the connection of the interior 14 of the tube (or front portion) 3 to the outside environment, and, thus, the radial connection.

As already explained briefly above, it is naturally possible to actually provide an implementation to an also geometrically radially designed, channel-shaped connection; this can take place by an appropriate design of the front regions of the rear portion 2 and/or of the rearward front wall of the outer portion 4 of the tube or front portion 3. The acoustic friction piece 10 can then be adapted, in each case, geometrically to the channel 9 formed in this manner and inserted into the latter and secured with the fit therein.

In this case, it is naturally possible to provide several such radial channels, and to connect several of these channels with mutually separated recesses 12, which makes it possible to provide different geometric and, as a result of the use different friction pieces, also different acoustic calibration possibilities. In the process, one radial connection itself can ensure the isobaric pressure compensation, a second one, which is in connection only with an outer opening 11, but into which the recess 12 opens, can be used for the ventilation of the transducer, and another, third one, which is closed off to the outside, but which opens into the interior 14 of the tube or front portion 3, in turn can be used, again with its own recess 12, as an acoustic short circuit.

If one compares the prior art and the invention one clearly recognizes that, the invention avoids all the problems with gluing smallest parts in thin and small holes and/or in deep recesses. Thereby, an easy assembling and a reproducible quality are obtained. The idea to provide the channel(s) by special designed surfaces of different constituting parts of the earphone, which, when mounted, form the channel(s)

between them, leads to a precise geometry and makes the providing, mounting and fixing of any acoustic friction piece(s) or any attenuation material much easier than in the prior art.

As materials, all the materials used in concha earphones or plug earphones in the prior art can be used, and, for the friction pieces as well, the person skilled in the art of the field of the construction of headphones can easily make the appropriate selection, in knowledge of the invention.

In the drawing, only an embodiment with a front portion including two portions, an inner and an outer one, has been explained. It is obvious for a person skilled in the art that, it is easily possible to combine the inner portion 4 and the outer portion 5 to a single piece as is known from some examples of the prior art, without leaving the scope of the invention.

It is possible to vary and change the shapes and sizes of the channels and hollow spaces depending on the implementation of the earpiece, of significance is the formation of the channel 9, preferably in a disk-like manner, between the parts forming the front portion and the parts forming the rear portion. This makes it possible to come to tuning possibilities without all the problems in the prior art.

In the description and the claims, the expression "to be in connection" means that one or more at least microscopically open channel(s) exist(s) between the respective hollow cavities or the environment in order to come to a pressure balance in combination with an aspired acoustic connection.

What is claimed is:

1. A plug earphone or concha earphone with a front portion and a rear portion, wherein a flexible plug can be placed on the front portion which includes an outer portion and an inner portion, and at least one electroacoustic transducer is arranged in the rear portion, wherein the front portion and the inner portion is positioned on at least one of the electroacoustic transducer and an opening of the rear portion produced in this area, wherein the inner portion and the outer portion, together with a front wall of the rear portion forms at least one radial channel that leads from an interior of the front portion to the outside, wherein an acoustic friction piece is arranged in the at least one radial channel and extends into an outer opening that is formed on the outer portion of the front portion, wherein the outer opening is defined by a first wall on the front portion and a second wall on the rear portion, and wherein the outer opening is positioned on an exterior of the plug earphone or the concha earphone.

2. The plug earphone or concha earphone according to claim 1, further comprising at least one recess provided in the rear portion which is in connection with the at least one radial channel with an open or hollow rear area that is provided beyond the at least one electroacoustic transducer.

3. The plug earphone or concha earphone according to claim 2, wherein the at least one radial channel between the connection for the at least one recess and an interior of the front portion is blocked.

4. The plug earphone or concha earphone according to claim 2, wherein the at least one radial channel between the connection for the at least one recess and an outside of the front portion is blocked.

5. The plug earphone or concha earphone according to claim 1 wherein the acoustic friction piece directly contacts an environment outside of the plug earphone or the concha earphone.

6. The plug earphone or concha earphone according to claim 1, wherein the at least one radial channel includes a gap between a rear wall of the front portion and the front wall of the rear portion.

7. The plug earphone or concha earphone according to claim 6, wherein the acoustic friction piece is provided in the gap and wherein a geometry and material distribution of which form different connections with the at least one recess.

8. The plug earphone or concha earphone according to claim 6, wherein the gap ends on an radially inner side on an outside of the inner portion where it is in connection with a channel extending in axial direction (A) in the outer portion and the channel is further in connection with an interior of the inner portion.

9. A plug earphone or concha earphone comprising: a front portion; a rear portion, wherein a flexible plug is capable of being placed on the front portion which includes an outer portion and an inner portion, and at least one electroacoustic transducer is arranged in the rear portion, wherein the front portion and the inner portion is positioned on at least one of the at least one electroacoustic transducer and an opening of the rear portion, wherein the inner portion and the outer portion, together with a front wall of the rear portion forms at least one radial channel that leads from an interior of the front portion to an outside of the front portion, wherein an acoustic friction piece is positioned in the at least one radial channel and extends into an outer opening that is formed on the outer portion of the front portion, wherein the outer opening is defined by a first wall on the front portion and a second wall on the rear portion, and wherein the outer opening is positioned on an exterior of the plug earphone or the concha earphone.

10. The plug earphone or concha earphone according to claim 9, further comprising at least one recess provided in the rear portion which is in connection with the at least one radial channel with an open or hollow rear area that is provided beyond the at least one electroacoustic transducer.

11. The plug earphone or concha earphone according to claim 10, wherein the at least one radial channel between the connection for the at least one recess and an interior of the front portion is blocked.

12. The plug earphone or concha earphone according to claim 10, wherein the at least one radial channel between the connection for the at least one recess and an outside of the front portion is blocked.

13. The plug earphone or concha earphone according to claim 9 wherein the acoustic friction piece directly contacts an environment outside of the plug earphone or the concha earphone.

14. The plug earphone or concha earphone according to claim 9, wherein the at least one radial channel includes a gap between a rear wall of the front portion and the front wall of the rear portion.

15. The plug earphone or concha earphone according to claim 14, wherein the acoustic friction piece is provided in the gap and wherein a geometry and material distribution of which form different connections with at least one recess.

16. The plug earphone or concha earphone according to claim 14, wherein the gap ends on an radially inner side on an outside of the inner portion where the gap is in connection with a channel extending in axial direction (A) in the outer portion and the channel is further in connection with the interior of the inner portion.

17. A plug earphone or concha earphone comprising: a front portion including an inner portion and an outer portion; a rear portion; and at least one electroacoustic transducer is arranged in the rear portion, wherein the front portion and the inner portion is positioned on the at least one electroacoustic transducer and an opening of the rear portion, wherein the inner portion and the outer portion, together with a front wall of the rear portion forms at least one radial channel that leads from an interior of the front portion to an outside of the front portion, wherein an acoustic friction piece is positioned in the at least one radial channel and extends into an outer opening that is formed on the outer portion of the front portion, wherein the outer opening is defined by a first wall on the front portion and a second wall on the rear portion, and wherein the outer opening is positioned on an exterior of the plug earphone or the concha earphone.

18. The plug earphone or concha earphone according to claim 17, further comprising at least one recess provided in the rear portion which is in connection with the at least one radial channel with an open or hollow rear area that is provided beyond the at least one electroacoustic transducer.

19. The plug earphone or concha earphone according to claim 18, wherein the at least one radial channel between the connection for the at least one recess and an interior of the front portion is blocked.

20. The plug earphone or concha earphone according to claim 18, wherein the at least one radial channel between the connection for the at least one recess and an outside of the front portion is blocked.

* * * * *